US008893453B2

(12) United States Patent
Van Bers

(10) Patent No.: US 8,893,453 B2
(45) Date of Patent: Nov. 25, 2014

(54) INTERMEDIATE FLOOR, METHOD FOR PRODUCING AN INTERMEDIATE FLOOR AND USE OF AN INTERMEDIATE FLOOR

(75) Inventor: Frederik Johannes Van Bers, Eindhoven (NL)

(73) Assignee: Elastilon B.V. (NL)

( * ) Notice: Subject to any disclaimer, the term of this patent is extended or adjusted under 35 U.S.C. 154(b) by 0 days.

(21) Appl. No.: 13/989,179

(22) PCT Filed: Feb. 16, 2011

(86) PCT No.: PCT/NL2011/050105

§ 371 (c)(1), (2), (4) Date: Aug. 5, 2013

(87) PCT Pub. No.: WO2012/112026

PCT Pub. Date: Aug. 23, 2012

(65) Prior Publication Data

US 2013/0305644 A1 Nov. 21, 2013

(51) Int. Cl.

| | |
|---|---|
| ***E04F 13/00*** | (2006.01) |
| ***E04F 15/22*** | (2006.01) |
| ***E04F 15/20*** | (2006.01) |
| ***E04F 15/02*** | (2006.01) |

(52) U.S. Cl.

CPC ..... *E04F 15/02155* (2013.01); *E04F 15/22* (2013.01); *E04F 15/20* (2013.01); *E04F 15/02038* (2013.01)

USPC ..... 52/746.1; 52/390; 52/745.21

(58) Field of Classification Search

USPC ..... 52/390–391, 747.1, 747.11, 745.21, 52/177; 156/160–164, 182, 184, 229, 249, 156/324; 428/40.1, 41.7, 41.8, 42.3

See application file for complete search history.

(56) References Cited

U.S. PATENT DOCUMENTS

| | | | | | |
|---|---|---|---|---|---|
| 4,789,699 | A | * | 12/1988 | Kieffer et al. | 524/271 |
| 4,988,551 | A | * | 1/1991 | Zegler | 428/41.8 |
| 5,114,781 | A | * | 5/1992 | Morman | 428/198 |
| 5,564,251 | A | | 10/1996 | Van Bers | |
| 5,763,330 | A | * | 6/1998 | Bertolucci et al. | 442/65 |
| 5,848,504 | A | * | 12/1998 | Guerinet et al. | 52/177 |
| 5,942,300 | A | * | 8/1999 | Lukowski, Sr. | 428/40.1 |
| 5,972,148 | A | * | 10/1999 | Lukowski, Sr. | 156/184 |
| 6,312,777 | B1 | * | 11/2001 | Smith | 428/41.8 |

(Continued)

FOREIGN PATENT DOCUMENTS

| | | | | |
|---|---|---|---|---|
| EP | 0629755 | * | 10/1998 | E04F 15/22 |
| WO | WO 2007123393 A1 | * | 11/2007 | E04F 15/02 |

OTHER PUBLICATIONS

International Search Report for PCT/NL2011/050105 dated Feb. 14, 2012.

*Primary Examiner* — William Gilbert
*Assistant Examiner* — Beth Stephan
(74) *Attorney, Agent, or Firm* — Shumaker, Loop & Kendrick, LLP

(57) ABSTRACT

An intermediate floor for a floor that is built up from elements laid on the intermediate floor, butting together with their edges. The intermediate floor includes an intermediate floor layer including an elastic and/or resilient material. The intermediate floor layer is bonded to an adhesive layer on one side for bonding the elements thereto, which adhesive layer is provided with a protective layer, such as a release sheet, which is detachable so that the elements can be bonded to the adhesive layer. A method for producing an intermediate floor and to the use of an intermediate floor.

12 Claims, 2 Drawing Sheets

(56) References Cited

U.S. PATENT DOCUMENTS 6,540,865 B1 * 4/2003 Miekka et al. ..... 156/249
7,601,657 B2 * 10/2009 Zhou et al. ..... 442/327
2007/0113972 A1 * 5/2007 Kikuchi et al. ..... 156/289
2007/0131343 A1 * 6/2007 Nordang ..... 156/229
2010/0300606 A1 * 12/2010 Kitada et al. ..... 156/184

* cited by examiner

INTERMEDIATE FLOOR, METHOD FOR PRODUCING AN INTERMEDIATE FLOOR AND USE OF AN INTERMEDIATE FLOOR

TECHNICAL FIELD AND BACKGROUND OF THE INVENTION

The invention relates to an intermediate floor that includes an intermediate floor layer, and adhesive layer, and a protective layer in which the adhesive layer is positioned in between the intermediate floor layer and the protective layer such that the protective layer forms a tension element for maintaining a tensile stress in the intermediate floor layer in a direction in a plane of the intermediate floor layer.

The invention also relates to a method for producing an intermediate floor by providing an intermediate floor layer, an adhesive layer, and a protective layer in which the adhesive layer is positioned in between the intermediate floor layer and the protective layer such that the protective layer forms a tension element for maintaining a tensile stress in the intermediate floor layer in a direction in a plane of the intermediate floor layer.

The invention further relates to a use of such an intermediate floor.

Such an intermediate floor is known from EP 0 629 755 A1. The known intermediate floor comprises a layer of an elastic and/or resilient material. At the upper side, said layer is bonded to an adhesive layer. On said adhesive layer a protective film, such as paper or the like, may be provided. Elements butting together with their edges, as is the case in a parquet floor, can be bonded to the intermediate floor. The known elastic intermediate floor prevents the formation of open seams and/or bulging or dishing of the abutting elements installed thereon when alternate shrinking and swelling takes place.

Although in practice the intermediate floor according to EP 0 629 755 is satisfactory in many cases, the intermediate floor has the drawback that the installation of the intermediate floor is a relatively labour-intensive job, because the known intermediate floor must be pulled taut lengthwise. Another drawback is that the capacity to offset the adverse effects of shrinking and swelling of the abutting elements installed on the intermediate floor, such as the formation of cracks between abutting elements, is limited, in particular in extreme conditions.

BRIEF SUMMARY OF THE INVENTION

Accordingly it is an object of the present invention to provide an intermediate floor which is better capable of preventing the adverse effects of shrinking and swelling of the abutting elements installed on the intermediate floor. Another object is to provide an intermediate floor which can be installed in a relatively simple manner and within a relatively short period of time, without a labour-intensive process being involved.

In order to accomplish that object, the invention provides an intermediate floor. The intermediate floor is provided with an intermediate floor layer of an elastic and/or a resilient material. On said intermediate floor layer an adhesive layer is provided. The adhesive layer is provided with a protective layer, such as a release sheet. According to the present invention, a tensile stress is present in the intermediate floor layer, in a direction in the plane formed by the intermediate floor layer. The term "tensile stress" is understood to mean a stress in the intermediate floor layer which, at least in the absence of other forces, leads to a compression of the intermediate floor layer. The intermediate floor layer may have been stretched, for example, so that a tensile stress is present in the intermediate floor layer. Said tensile stress urges the intermediate floor layer back to the non-stretched position. The protective layer forms a tension element for maintaining the tensile stress in the intermediate floor layer. It has been found that such an intermediate floor surprisingly prevents the adverse effects caused by shrinking of the elements provided on the intermediate floor. A reason for this is that the tensile stress in the intermediate floor layer provides a certain degree of compression relative to the protective layer. Upon installation of the intermediate floor, a tensionless state will be created in the protective layer, for example by rolling out and smoothing the adhesive layer with the protective layer present thereon. Subsequently, the floor elements will be placed on the protective layer, whereupon the protective layer is pulled out from under the floor elements. The floor elements bonded to the adhesive layer now form a tension element for maintaining the tensile stress present in the intermediate floor layer. In other words, the protective layer is replaced as the tension element by the floor elements, which function as substitute tension elements. As a result, a tensile stress is present in the intermediate floor layer in an installed condition of the floor. Upon shrinkage of the individual floor elements, the pre-tensioned intermediate floor layer will undo the effects of said shrinkage, such as the formation of open seams, by pulling the elements of which the floor is built up together again. As a result, the formation of seams between abutting elements will be prevented to an increased extent. The natural properties of floor elements made of wood, for example, viz. swelling and shrinking, and their drawbacks when used in floors, are prevented by using the present invention. Upon swelling of floor elements, the intermediate floor layer will develop more tensile stress, whilst upon shrinking the tensile stress in the intermediate floor will cause the elements to be pulled together. Thus the object of the present invention is accomplished.

As already mentioned before, the protective layer may be a release sheet of paper or the like. The protective layer may be a film that is known to the skilled person, so long as it is capable to maintain a tensile stress in the intermediate floor layer. The protective layer may be a siliconized protective layer, such as a siliconized paper of sufficient tensile strength.

In order to be better able to maintain the tensile stress, the adhesive layer may be provided with a reinforcement mesh, for example a matrix of fibre reinforcements.

In one embodiment, the tensile stress may be limited to a substantially longitudinal direction of the intermediate floor. The intermediate floor can then be installed in such a manner that elements placed perpendicularly to a longitudinal direction of the intermediate floor are pulled together in lateral direction. Limiting the tensile stress to one longitudinal direction prevents unnecessary stresses being set up, for example in axial direction, in the elements.

According to one aspect of the invention, a method is provided for form an intermediate floor. According to the invention, the method comprises the steps of setting up a tensile stress in the intermediate floor layer in a direction in the plane formed by the intermediate floor layer, preferably a longitudinal direction of the intermediate floor layer, and bonding the protective layer to the intermediate floor layer via the adhesive layer in these conditions. The protective layer is bonded to the intermediate floor layer in such a manner that the protective layer forms a tension element for maintaining a tensile stress in the intermediate floor layer in a direction in the plane formed by the intermediate floor layer. As a result of the greater tensile stress in the intermediate floor layer, a tension pre-stress is set up in the intermediate floor layer. In an installed position of the intermediate floor, the floor elements will act as substitute tension elements for maintaining a tensile stress in the intermediate floor layer. Said pre-tension in the intermediate floor layer will prevent the adverse effects of shrinkage of the elements installed on the intermediate floor to an increased extent, as already described in the foregoing.

The method can be carried out in a relatively simple manner if the step of setting up a tensile stress is carried out by executing the method step of stretching the intermediate floor layer.

Preferably, a tensile force is applied to the intermediate floor layer for setting up a tensile stress in the intermediate floor layer.

It has been found that an intermediate floor according to the present invention is very effective in preventing shrinkage cracks and in preventing swelling if the intermediate floor layer undergoes a relative stretch of 0.5-5%, more preferably 0.75-2.25%, relative to the protective layer during the production thereof. Other values are conceivable, of course, if necessary. A higher degree of stretch will be required in some floors or elements.

In a very simple embodiment, the intermediate floor layer is supplied from a first feed roll, the protective layer is supplied from a second feed roll, and the intermediate floor is rolled up on a storage roll, wherein the method comprises the step of using a higher rotational resistance for the first feed roll in comparison with the second feed roll and the storage roll. As a result of the higher rotational resistance, the product being supplied from the first feed roll will be stretched in a simple manner. The setting up of a rotational resistance is a very simple operation, which furthermore can take place in a very precise manner, such that an end product exhibiting a constant tensile stress is provided. The risk of breakage of the material being supplied is prevented. The adhesive layer may be applied to the protective layer before the protective layer is bonded to the intermediate floor layer, but it may also be applied previously to the intermediate floor layer. It is preferable to apply the protective layer, which is preferably provided with a reinforcement mat, to the protective layer in advance and bonded to the stretched intermediate floor layer in this condition.

According to another aspect of the invention, use is made of an intermediate floor. The advantages of the intermediate floor, and the use thereof, have already been described in the foregoing.

In one embodiment, said use comprises the forming of a floor built up of elements butting together with their edges, which are laid on the intermediate floor. The forming of such a floor is less labour-intensive in comparison with the known floor, which needs to be pulled taut, since the subfloor according to the invention is already tensioned and hardly needs to be pulled taut, if at all. In addition, fixing the floor to the existing subfloor construction, for example by glueing, is not necessary.

BRIEF DESCRIPTION OF THE DRAWINGS

The invention will now be explained in more detail by means of a description of a drawing in which.

DETAILED DESCRIPTION OF THE INVENTION

Figure 1A:
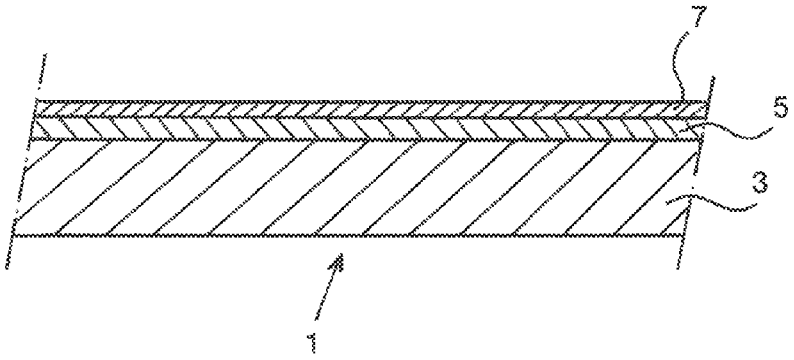
FIG. 1*a* is a sectional view of an intermediate floor according to the present invention.

FIG. 1*a* shows an intermediate floor 1. The subfloor construction is provided with an intermediate floor layer 3 consisting of an elastic and/or a resilient material. The intermediate floor layer 2 may be made up of an open or closed cellular, solid or non-solid layer of plastic material and/or a rubber. The intermediate floor layer 3 may consist of a PE foam, for example. Present on an upper side of the intermediate floor layer 3 is an adhesive layer 5. Said adhesive layer, which may be provided with a reinforcement mesh, is covered with a protective layer 7 consisting of a siliconized tension-resistant paper or the like. Said protective layer 7 forms a release sheet 7. According to the invention, the protective layer 7 forms a tension element for maintaining a tensile stress in the intermediate floor layer 3 in a direction in the plane formed by said intermediate floor layer. The intermediate floor layer 3 is slightly stretched, so that a tensile stress is present in the material. Said tensile stress will cause the intermediate floor layer 3 to return to the original, non-stretched condition. However, the protective layer 7 forms a tension element which opposes said return to the undeformed condition of the intermediate floor layer 3. In other words, the protective layer maintains a tensile stress in the intermediate floor layer 3. The stretch in the intermediate floor layer 3 may amount to 0.5-5%, for example, preferably, however, it ranges between 0.75% and 2.25%, for example 1%, or 2%, since it has been found that the improved properties of the intermediate floor 1 specially come out well with these values.

Figure 1B:
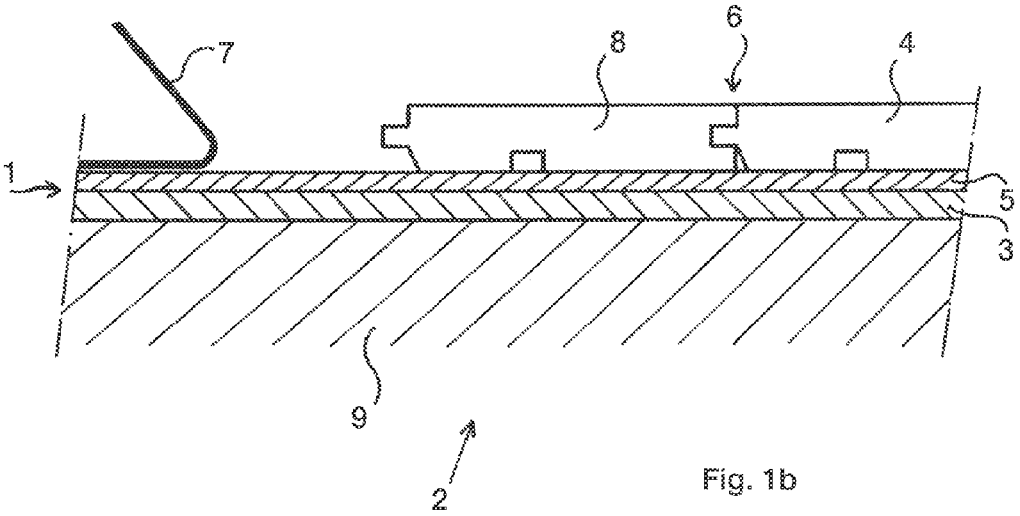
FIG. 1*b* is a sectional view showing a use of the intermediate floor according to the present invention.

FIG. 1*b* schematically shows a sectional view of a part of a floor 2 during the laying of the floor 2. The figure shows the subfloor construction 9 that is usually present in a building or the like, which subfloor is in many cases made up of a concrete floor provided with a screed layer, but it may also be made up of a wooden subfloor or the like, for example. On said subfloor construction 9, an intermediate floor 1 according to the present invention is present. The intermediate floor 1 again comprises an intermediate floor layer 3, which is provided with an adhesive layer 5 at an upper side thereof. The adhesive layer is partially covered by a protective layer 7, such as a release sheet 7. Installed on top of the adhesive layer 5 is a floor 6 consisting of floor elements 4. Upon installation of the floor 6, the intermediate floor 1 will first be placed on the existing subfloor construction 9. Preferably, the intermediate floor 1 is not fixed to the existing subfloor construction 9. This obviates the need to use a glue, additional adhesive layers on the underside of the intermediate floor 1 or mechanical fixation means. Fixation of the intermediate floor to the subfloor construction can or even will counteract or even undo the effect of the intermediate floor 1 according to the present invention.

After the intermediate floor 1 has been laid on the existing subfloor construction 9, the protective layer 7 is pulled back near one end of the intermediate floor 1 over a width which approximately corresponds to the width of the first element 4 of the floor 6, which is subsequently bonded to the intermediate floor layer 3 by means of the adhesive layer 5.

The pulled-off part of the protective layer 7 is folded back and laid on top of the part of the protective layer 7 that still adheres to the intermediate floor layer 3. On said folded part of the protective layer 7 the next floor element 8 to be installed is laid and firmly pressed against the first element 4, so that a nicely connected whole is formed. If the abutting edges of the elements have a tongue and groove configuration, as in the illustrated embodiment, they will be driven together to form a connected whole upon installation of the successive elements.

After the element 8 has thus been pressed against the element 4 to form a nicely connected whole, the protective layer 7 can be pulled out from under the element 8, thereby placing the element 8 in direct contact with the adhesive layer 5 and bonding it to the intermediate floor layer 3. The next floor element can be installed in a similar manner again, so that eventually all the elements, correctly butting together, are bonded to the intermediate floor layer 3.

Since a tensile stress has been set up in the intermediate floor layer 3, and since the protective layer 7, for example in combination with the reinforcement mesh that may be provided in the adhesive layer, forms a tension element for maintaining the tensile stress in the intermediate floor layer 3, the effect achieved with the above-described method for installing the floor 6 is that the intermediate floor layer 3 is bonded to the floor elements 4, 8 in a slightly stretched condition. The tensile stress in the intermediate floor layer 3 can for example be achieved by stretching the intermediate floor layer 3 slightly and subsequently bonding the adhesive layer 5 provided with the protective layer 7 to the intermediate floor layer 3. The tensile stress in the intermediate floor layer 3 can be such that the intermediate floor layer 3 experiences some shrinkage upon removal of the protective layer 7, to an extent equal to one or two centimetres per metre of the intermediate floor layer 3. By stretching the intermediate floor layer 3 and bonding it to the floor elements 4, 8 in this condition it is achieved that shrinkage of the floor elements 4, 8 will not result in the formation of cracks or open seams between the floor elements 4, 8. After all, the stretched intermediate floor layer 3 will no longer experience any resistance against shrinkage upon shrinkage of the floor elements 4, 8. The intermediate floor layer 3 can thus shrink slightly, as a result of which the floor elements 4, 8 will be pulled closer together again. Initially, shrinkage of the floor elements 4, 8 will not lead to the formation of cracks between the floor elements 4, 8, therefore.

Figure 2:
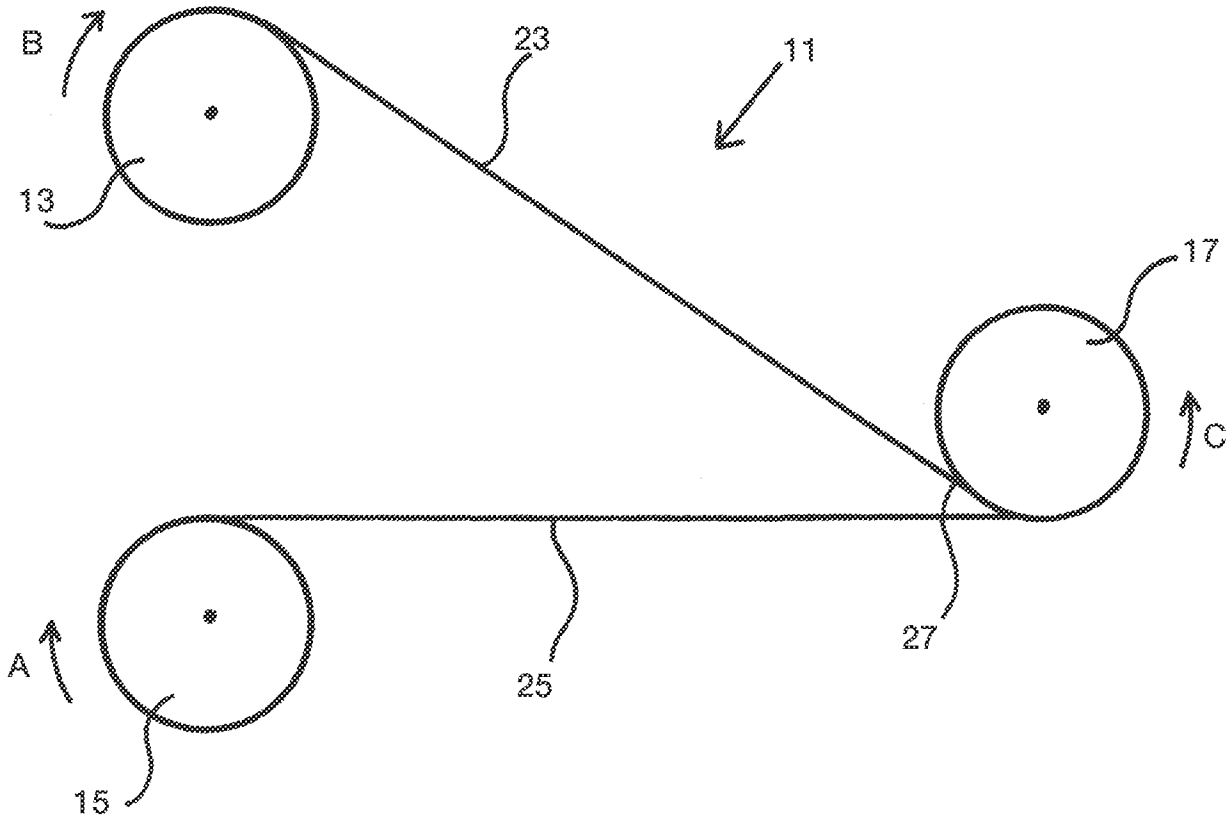
FIG. 2 is a sectional view of the device for producing an intermediate floor according to the present invention during the production process.

FIG. 2 shows a possible method of producing an intermediate floor 1 according to the present invention. FIG. 2 schematically shows a device 11 for forming an intermediate floor according to the present invention. The device 11 comprises a first roll 15, a second roll 13, and a third roll 17. The first roll 15 functions to supply the intermediate floor layer 25. To that end the intermediate floor layer 25, for example a polyethylene foam, is present on the first roll. Present on the second roll 13 is an adhesive layer indicated as a whole at 23, possibly provided with a reinforcement mesh, covered with a protective layer, such as a release sheet. Said adhesive layer is supplied as a whole. Near the third roll 17, which forms a storage roll for the formed product 27, the whole 25 of the adhesive layer and the protective layer is (will be) bonded to the intermediate floor layer 25.

Before the intermediate floor layer 25 is bonded to the adhesive layer and the protective layer 23, a tensile stress is set up in the intermediate floor layer 25. Said setting up of a tensile stress in the intermediate floor layer takes place by slowing down the unrolling of the first roll 15 relative to the second roll 13, for example, or by imparting a greater resistance to the first roll 15 in comparison with the second roll 13, so that the material (the intermediate floor layer 25) being unrolled from the first roll 15 is unrolled with relatively more tension. In this condition the intermediate floor layer 25 is bonded to the adhesive layer and the protective layer 23. The protective layer 23 is such that it forms a tension element for maintaining the tensile stress in the intermediate floor layer 25. The intermediate layer 25 has been slightly stretched, and in this condition it has been bonded to the protective layer. The intermediate floor layer 25 consists of an elastic and/or a resilient material, which is selected so that the stretching of the intermediate floor layer 25 will hardly lead to plastic deformation of the material, if at all. The intermediate floor layer 25 is made of a PE foam, for example.

The stretching of the intermediate floor layer 25 takes place as follows. Upon production of the intermediate floor layer, the material is supplied from two rolls 13, 15 and stored on a single roll 17. The third roll 17, on which the end product, i.e. the intermediate floor according to the present invention, is stored, is wound with a specific winding speed, for example by supplying a constant power to the third roll 17. The second roll 13 can rotate without any appreciable resistance, such that the unwinding speed of the protective layer 23 is to a high degree equal to the winding speed, so that no appreciable stretch will take place in the protective layer. To the first roll 15, which functions to supply the intermediate floor layer 25, a specific, preferably constant, resistance is imparted, however. Effectively, the unwinding speed of the intermediate floor layer 25 will as a result be lower than the unwinding speed of the protective layer, and lower than the winding speed of the end product. As a result, a tensile stress will be set up in the intermediate floor layer 25, which is subsequently slightly stretched to a sufficient extent. In this stretched condition the intermediate floor layer 25 is bonded to the at least one protective layer 23. The resistance or braking effect imparted to the first roll 15 is adjustable so as to make it possible to obtain a larger or a smaller tensile stress in the intermediate floor layer 25.

In the embodiment shown in FIG. 2, the foam layer, or the intermediate floor layer 25, is supplied from the first roll 15, and the adhesive layer provided with the protective layer is supplied from the second roll 13. Production of the intermediate floor can thus take place relatively quickly.

It should be apparent to those skilled in the art that many alternatives are possible within the scope of the invention, which alternatives can be derived by those skilled in the art. The invention is not limited to that which is described in the foregoing, however.

The invention claimed is:

1. An intermediate floor for use with a floor including abutting elements laid on the intermediate floor, comprising:

an intermediate floor layer bonded to an adhesive layer on one side for bonding the abutting elements thereto, the adhesive layer including a protective layer that is detachable from the adhesive layer so that the abutting elements can be bonded to the adhesive layer, wherein the intermediate floor layer is stretched 0.5-5 % relative to the protective layer and the protective layer forms a tension element for maintaining a tensile stress in the intermediate floor layer in a direction in a plane of the intermediate floor layer.

2. The intermediate floor according to claim 1, wherein the tensile stress is limited to a substantially longitudinal direction of the intermediate floor.

3. The intermediate floor according to claim 1, wherein the intermediate floor layer includes an elastic material.

4. The intermediate floor according to claim 1, wherein the intermediate floor layer includes a resilient material.

5. The intermediate floor according to claim 1, wherein the intermediate floor layer includes a material that is elastic and resilient.

6. The intermediate floor according to claim 1, wherein the intermediate floor consists of the intermediate floor layer, the protective layer, and the adhesive layer positioned between the intermediate floor layer and protective layer.

7. A method for producing an intermediate floor, comprising the steps of:

a. providing an intermediate floor layer including one of an elastic material, a resilient material, and an elastic and resilient material;

b. providing an adhesive layer; and c. providing a protective layer on the adhesive layer that is releasable therefrom, by forming a tensile stress in the intermediate floor layer in a direction in a plane of the intermediate floor layer by stretching the intermediate floor layer 0.5-5 % relative to the protective layer and bonding the protective layer to the intermediate floor layer via the adhesive layer such that the protective layer forms a tension element for maintaining a tensile stress in the intermediate floor layer in a direction in the plane of the intermediate floor layer.

8. The method according to claim 7, wherein the tensile stress is achieved by stretching the intermediate floor layer.

9. The method according to claim 8, wherein the stretching of the intermediate floor layer is achieved by applying a tensile force to the intermediate floor layer.

10. The method according to claim 7, further comprising supplying the intermediate floor layer from a first feed roll, supplying the protective layer from a second feed roll, bonding the intermediate floor layer to the protective layer thereby producing the intermediate floor, and rolling the intermediate floor on to a storage roll, wherein:

the first feed roll has a higher rotational resistance than the second feed roll and the storage roll, and the intermediate floor layer is stretched 0.75 to 2.25% relative to the protective layer.

11. The method according to claim 8, wherein The intermediate floor layer is stretched 0.75-2.25% relative to the protective layer.

12. The method according to claim 7, wherein the intermediate floor consists of the intermediate floor layer, the protective layer, and the adhesive layer positioned between the intermediate floor layer and the protective layer.

* * * * *